US007465001B2

(12) United States Patent
Lam et al.

(10) Patent No.: US 7,465,001 B2
(45) Date of Patent: Dec. 16, 2008

(54) DRAWER PULL OUT GUIDE RAIL

(75) Inventors: Harn Lian Lam, Perak (MY); Harn Yan Lam, Perak (MY)

(73) Assignee: Harn Marketing Sdn Bhd, Ipoh, Perak (MY)

( * ) Notice: Subject to any disclaimer, the term of this patent is extended or adjusted under 35 U.S.C. 154(b) by 274 days.

(21) Appl. No.: 10/577,215

(22) PCT Filed: Nov. 4, 2004

(86) PCT No.: PCT/SG2004/000363

§ 371 (c)(1),
(2), (4) Date: Apr. 26, 2006

(87) PCT Pub. No.: WO2005/044047

PCT Pub. Date: May 19, 2005

(65) Prior Publication Data

US 2007/0080617 A1 Apr. 12, 2007

(30) Foreign Application Priority Data

Nov. 5, 2003 (MY) ..... PI20034219

(51) Int. Cl.
*A47B 88/04* (2006.01)

(52) U.S. Cl. ..... 312/334.15; 312/334.33

(58) Field of Classification Search ..... 312/330.1, 312/334.1, 334.6, 334.7, 334.11, 334.14, 312/334.15, 334.27, 334.32, 334.33, 334.36, 312/334.37, 334.39; 384/18, 19

See application file for complete search history.

(56) References Cited

U.S. PATENT DOCUMENTS

| | | | | |
|---|---|---|---|---|
| 4,955,160 | A | 9/1990 | Röck | |
| 5,344,227 | A * | 9/1994 | Rock et al. | 312/334.6 |
| 5,417,489 | A * | 5/1995 | Compagnucci | 312/334.11 |
| 5,779,333 | A * | 7/1998 | Lautenschlager | 312/334.15 |
| 2003/0197452 | A1 | 10/2003 | Kung | |

FOREIGN PATENT DOCUMENTS

| | | |
|---|---|---|
| DE | 4432821 A1 | 3/1996 |
| EP | 0406647 A2 | 1/1991 |

* cited by examiner

*Primary Examiner*—James O Hansen
(74) *Attorney, Agent, or Firm*—Volpe and Koenig P.C.

(57) ABSTRACT

A drawer guide rail for a stabilized and guided in and out movement of a drawer with respect to the furniture member, having at least one surface of the pull out channel mounted on the bottom surface of the drawer, and a fixed guide (20) adapted to be fastened on either side or both sides of the inner sidewalls of the respective furniture member. The guide rail assembly includes an outer pull out channel (50), intermediate pull out channel (30) and roller units (15, 25) for allowing the relative movement of the pull out channels. The essential part of the present invention is an additional stabilizer means (10), in the form of a metal plate adapted to provide a running surface and is disposed between two roller units (15, 25) accordingly, to facilitate absorbance of vertical forces and stabilized drawer motion.

5 Claims, 4 Drawing Sheets

DRAWER PULL OUT GUIDE RAIL

FIELD OF THE INVENTION

The present invention relates to an improved pull out guide rail for a drawer, capable of withstanding maximized drawer volume and to secure lateral guiding of said drawer.

BACKGROUND OF INVENTION

A conventional guide rail assembly or arrangement basically consists of a stationary or fixed guide fastened to a portion of the furniture member, specifically the inner side walls of the furniture member, and an intermediate pull out rail and an outer pull out guide. These conventional guide rails have undergone recent advances and enhancements to prevail major drawbacks mostly related to load carrying capability of the guide rails, and the sloppiness in and out movement of the drawer.

While the existing guide rails may offer some conveniences, most of them lack of stability. This includes very low dynamic stability and rigidity when a relatively heavy load is applied to the drawer and indirectly to the guide rail.

One possible approach to cope with the situation above is the usage of roller balls, within the drawer guide rail. It is understood that the usage of these roller balls aid to absorb and spread vertical forces over a larger area, within the rails. Nevertheless, the usage of roller balls solely permits limited loading and may be ineffectual with extreme loading.

Other disadvantages of the out in the market drawer guide include the lack of rollers contacts within a guide rail. Most of the existing guide rails are equipped with rollers on each outer surface of the pull out channels, for allowing the smooth in and out movement of the guide rail along with the drawer. Such guide rail may operate excellently with less loading of the drawer, however can be inefficient when a heavy load is applied.

Recognizing the aforementioned shortcomings, the invention further develops the stability of the guide rail.

It is an object of the present invention to provide a more stabilized and secured lateral movement of the drawer and as well able to withhold extensive drawer load, by providing an additional element, so as to provide more force absorbance capability.

It further an object of the present invention to provide a motion stabilizer for relatively heavy or light drawers, loaded or unloaded, installed relatively on the bottom surface of the drawer, for in and out movement of the respective furniture.

SUMMARY OF INVENTION

The present invention discloses a drawer guide rail assembly mounted for a guided and stabilized in and out movement with respect to a furniture member comprising: A drawer guide rail assembly mounted for a guided and stabilized in and out movement with respect to a furniture member comprising: a fixed guide for attachment to an inner sidewall of the furniture member and having at least one running surface; wherein the running surface is a T-shaped flange extending upwards; an intermediate pull out channel section capable of sliding back and forth relative to said fixed guide on said running surface of said fixed guide; the upper surface of said intermediate pull out channel section providing a second running surface and housing a first roller bearing unit; an outer pull out channel section for attachment to the undersurface of a drawer capable of sliding back and forth on said intermediate pull out channel relative to said intermediate pull out channel section and for housing a second roller bearing; a stabilizing means positioned between said intermediate pull out channel and said outer pull out channel; first and second roller bearing fitted within the respective channels in a manner whereby each of said roller bearing prevents lateral movement within said guide rail.

DETAILED DESCRIPTION OF THE INVENTION

The invention basically provide an arrangement of a guide rail for a more stabilized movement of a drawer when inserted in the furniture member or any supporting structure, especially when accommodating a significant amount of weight.

Figure 1:
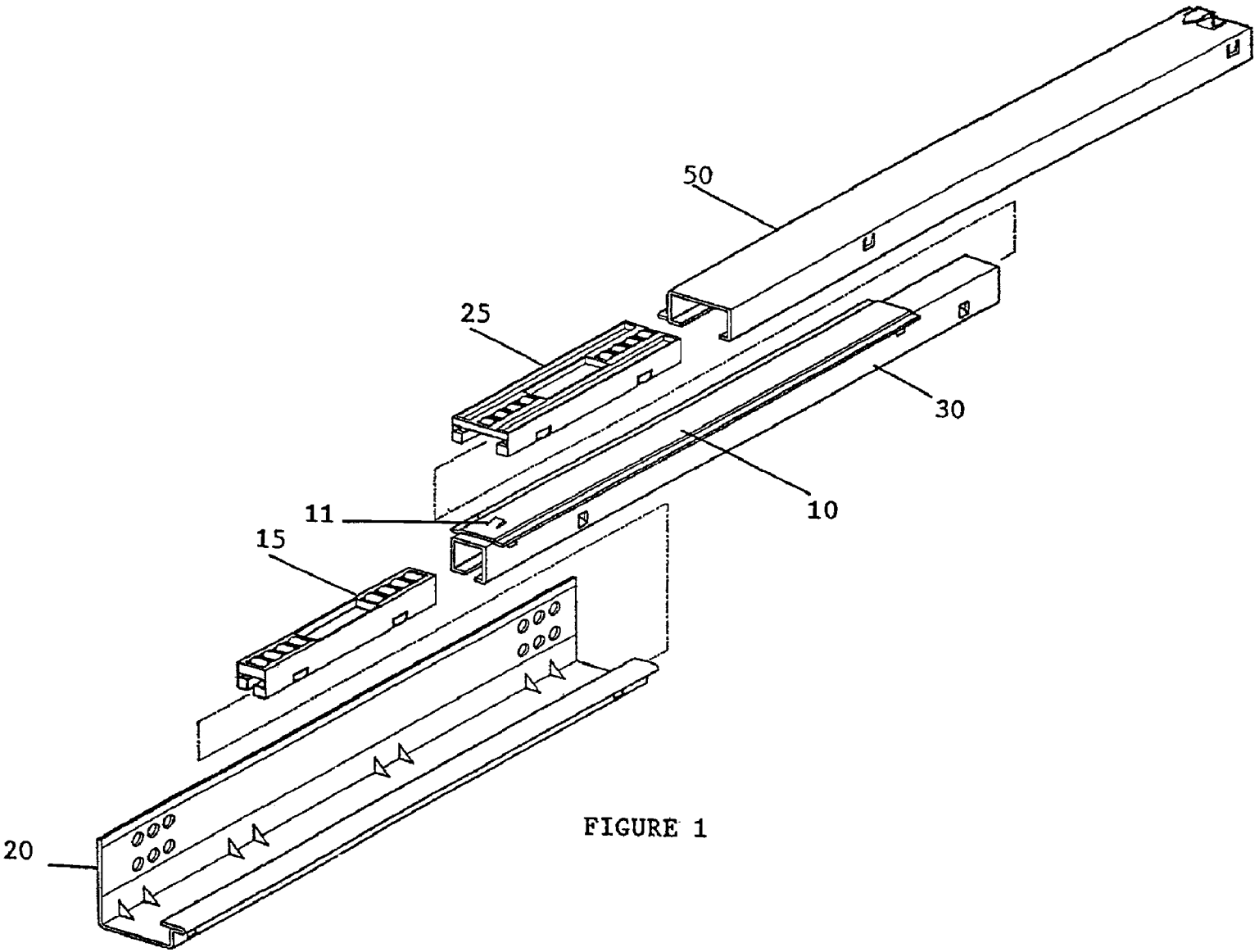
FIG. 1 is an exploded view of the parts of a guide rail assembly in accordance with the present invention.
Figure 4:
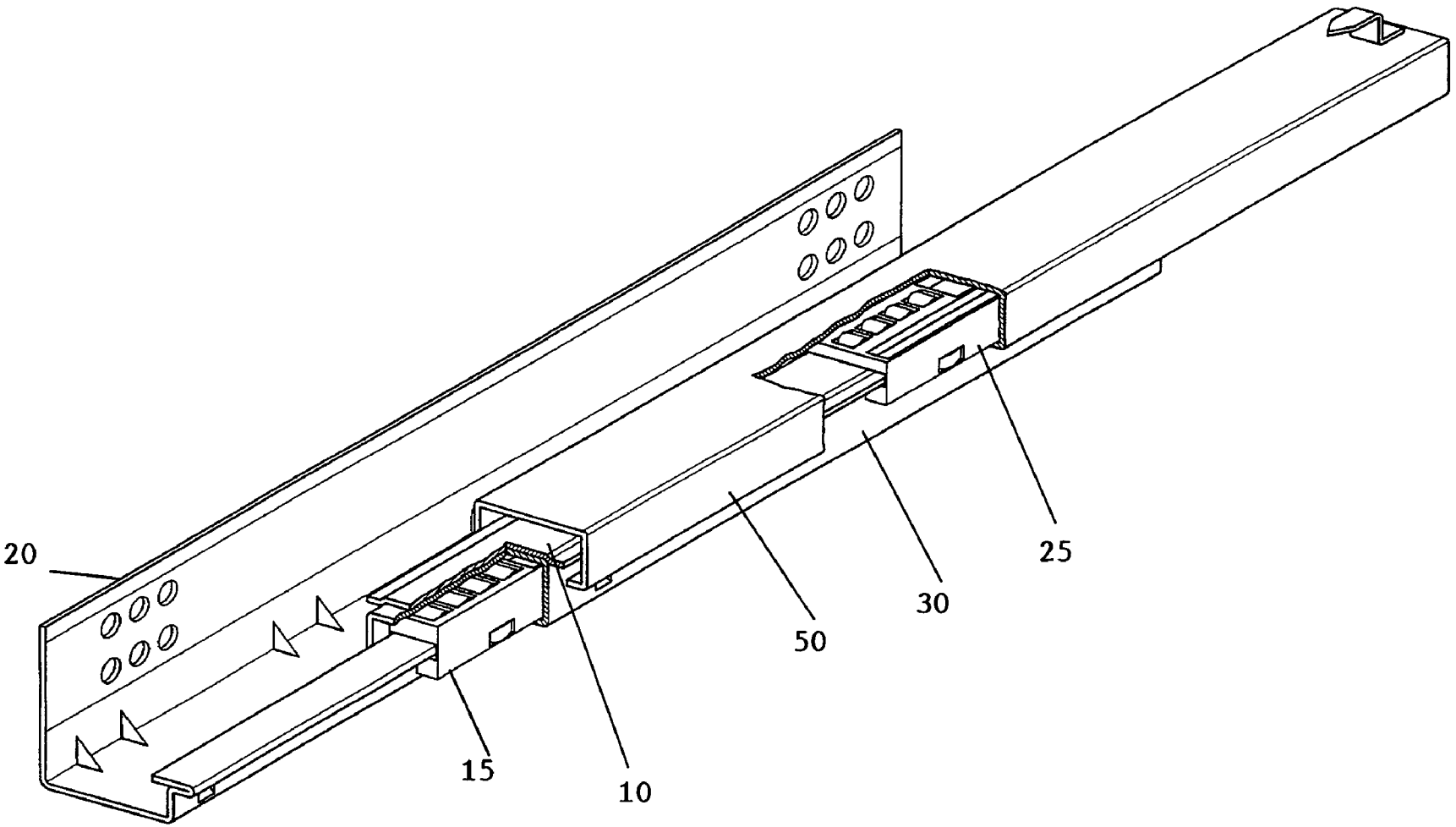
FIG. 4 is a perspective view of a fully assembled guide rail assembly of FIG. 1.

FIG. 1 and FIG. 4 depict the overall views of the guide rail in accordance to the preferred embodiments of the present invention, having a fixed guide mounted on the opposite inner walls of the furniture member and one component of the guide rail is accordingly mounted on the bottom surface of the drawer itself.

In this invention, the drawer in and out movement is accordingly guided and stabilized while supported by support means referred herein as the fixed guide.

The present invention comprises a fixed guide, an intermediate pull out channel, stabilizing means, outer pull out channel, and roller unit for allowing the translational movement of the subject guide rail assembly.

The essential part of the present invention is the stabilizer 10, in which the said stabilizer is detachable and preferably appended in between the intermediate pull out channel and the outer pull out channel.

Various embodiments of the guide rail according to the present invention are described below with reference to the accompanying drawings.

As can be seen in FIG. 1, the fixed guide 20 is formed preferably from a sheet metal or any suitable material into an L-section. The upper free edge of the horizontal plate of the L-section bracket is bent upwardly to form a T-cross section, configured accordingly to receive the intermediate pull out channel and forming a first running surface. In this context, the height of this T-cross section is significantly less than the height of the vertical surface of the L-shaped fixed guide 20.

Further, on the said vertical surface of the L-section fixed guide 20 is provided with fastening bores adapted to receive suitable fastening means for mounting through the inner sidewalls of the furniture member.

The intermediate channel 30 is in the form of an open C-section with unequal sides, forming the second running surface in the upper area. At the upper end and rear end of each side of the channel 30 is punched and formed a hook like protrusion, extending inwards, so as to hold the roller unit in place during the in and out movement of the guide rail.

The stabilizer 10 in accordance with the present invention is preferably detachable and in the form of a planar metal plate, having slightly inclined sides defining a shoulder on each side for guiding and stabilizing the in and out movement of the outer pull out channel 50. In this context, the measurement across the plate is considerably more than the width of the intermediate pull out channel 30 however is slightly less than the width of the outer pull channel 50 as best seen in FIG. 1. At the upper end of said plate is punched and formed a protrusion 11 extending outwards for holding roller units 15, 25 in position during movement.

The stabilizer may as well act as a support for the guide rail, especially during the in and out movement of the drawer.

Still referring to FIG. 1, the outer pull out channel is in the form of an open C-section, in which the width of the said outer pull out channel 50 is substantially configured to receive the stabilizer 10 and capable to slide therein. As the rear edge of the upper surface of the outer pull out channel 50 is provided with an inverted L-shaped extension which functions as a back stopper 35, whereby this back stopper holds the drawer when it is pulled out. According to the present invention, the top surface of the outer pull out channel is preferably mounted to the bottom surface of the drawer to provide support and guide the movement of the drawer.

A roller bearing 15, 25 consist of several cylindrical roller bodies held by a suitable receptacle, whereby the alignments of the roller bodies are generally parallel to the movement direction. On each opposite sides of the roller receptacle is also provided with roller bodies accordingly held in a position suitable to provide a side rolling contact. In this context, the roller second roller unit functions to hold the stabilizer in position during stationary state and during the in and out movement of the drawer.

The operational effect of the guide rail according to the present invention will be described herein below, and with reference to the accompanying drawings.

When the guide rail is assembled, the first roller bearing 15 is accordingly disposed over the upper running surface of the fixed guide 20. The intermediate pull out channel 30 fits slidably over the first roller bearing 15 as well as the T-section of the fixed guide 20. In this connection, the intermediate pull out channel slides smoothly with the aid of the first roller unit.

The stabilizer 10 is preferably disposed between the second roller bearing 25 and intermediate pull out channel as best shown in FIG. 1. The outer pull out channel 50 fits slidably over the second roller bearing 25 and the stabilizer 10.

Figure 2:
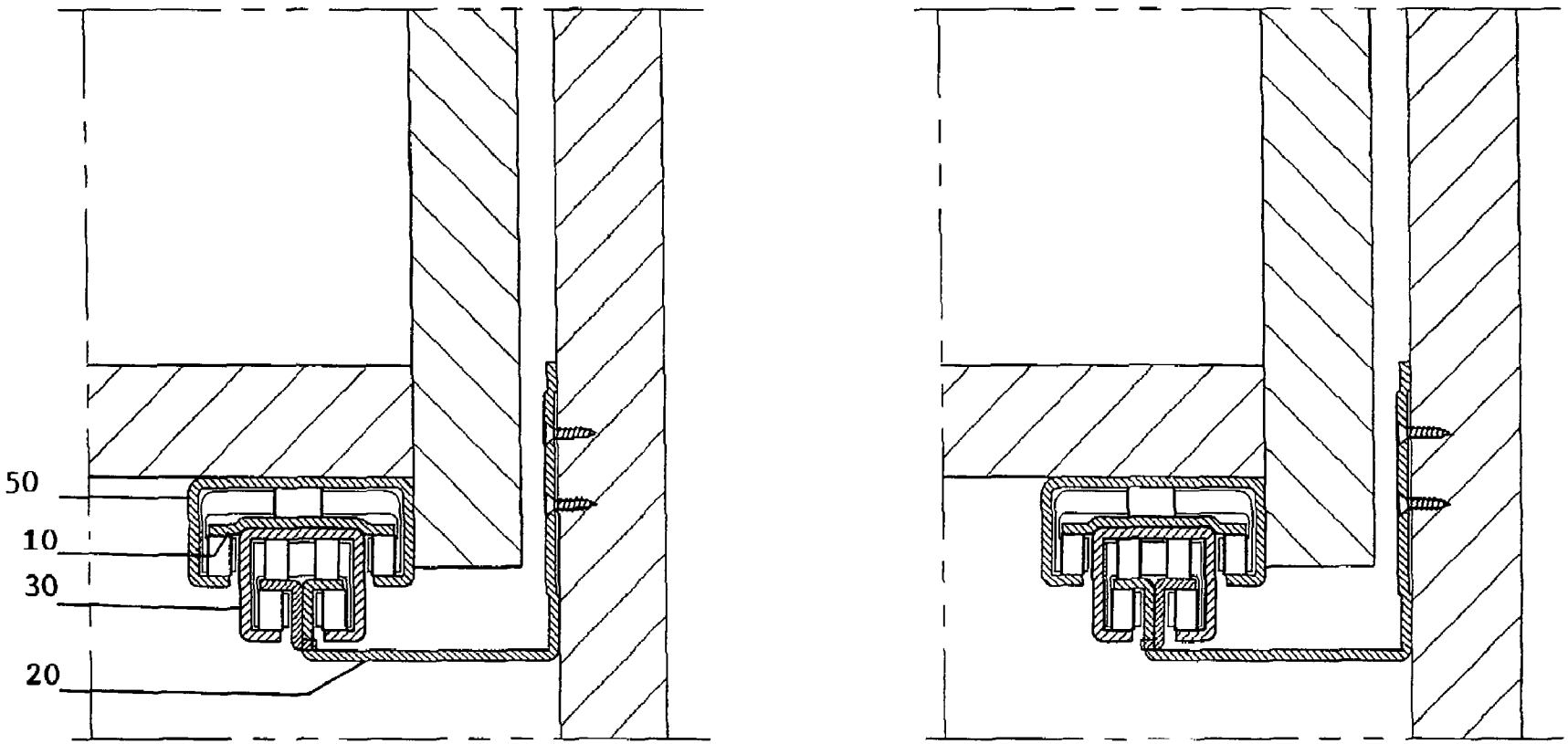
FIG. 2 shows a sectional view of a drawer having a guide rail assembly of FIG. 1.

During normal operational use of the drawer guide, first, the fixed guide 20 is fastened accordingly to the inner sidewalls of the furniture member by rivets or the like. In this connection, there is a gap between the inner sidewalls of the respective furniture member and the outer sidewalls of the drawer, to provide unhindered lateral movement of the drawer. Then, the first roller unit is placed over the running surface of the fixed guide 20, together with the intermediate pull out channel 30. This process is shown in FIGS. 1 and 2, whereby FIG. 2 depicts the drawer in a pulled out position.

Figure 3:
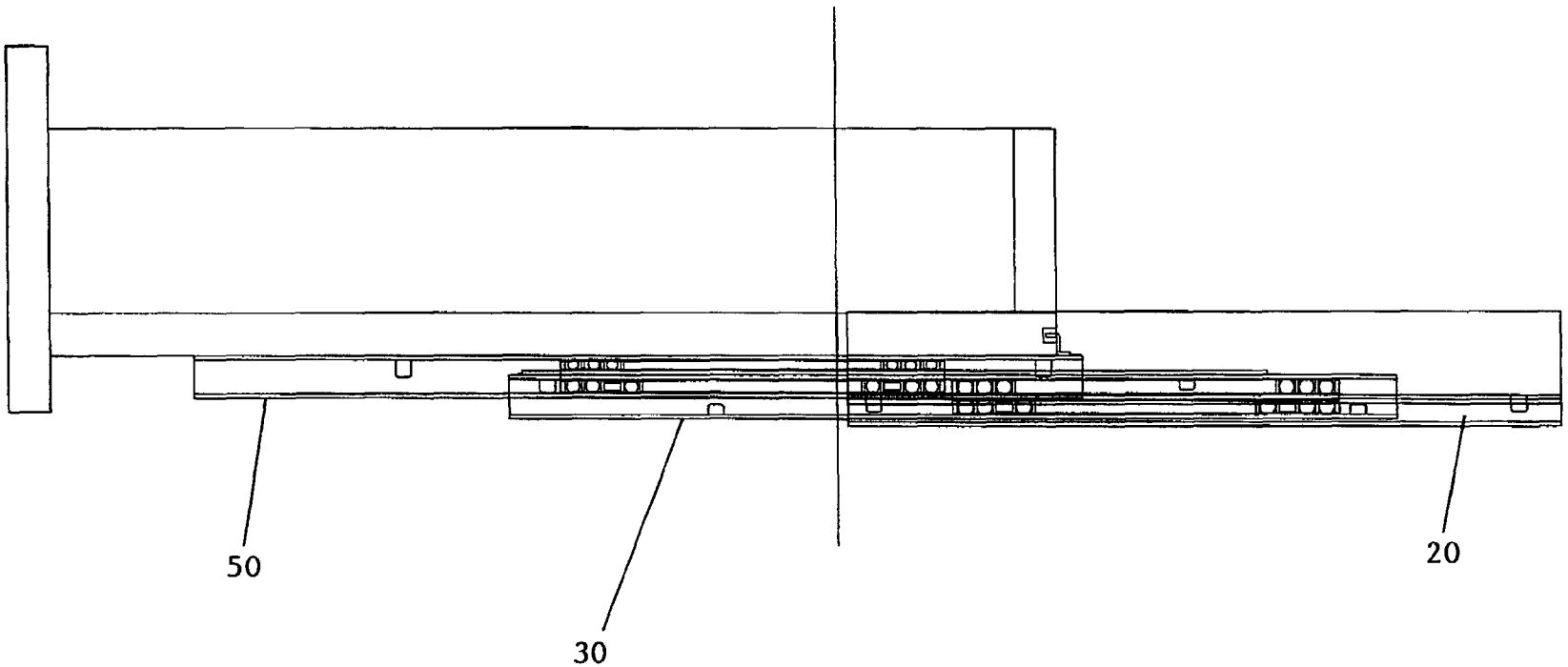
FIG. 3 shows a side view of a drawer having a guide rail assembly of FIG. 1, in a pulled-out state.

Next and as best seen in FIG. 4, the separable stabilizer is mounted on the top surface of the intermediate channel pull out channel 30 while the second roller unit is disposed over the stabilizer, and the outer pull out channel is placed accordingly over the second roller unit as well as the stabilizer, as shown in FIG. 3 of the present invention. In this connection, the second roller unit provides a rolling contact between the intermediate pull out channel as well as the outer pull out channel. The outer pull out channel is permanently connected or secured to the bottom surface of the drawer by suitable fastening means or the like.

In this embodiment, the intermediate pull out channel can be moved relative to the first roller bearing and the running surface of the fixed guide 20 together with the outer pull out channel. In this event, the first roller accordingly disposed over the running surface prior to the intermediate pull out channel 30 can as well roll on the said running surface. For the operation of drawer in a horizontal position, there is provided two points of contact of the rollers is sufficient to facilitate in maintaining the stabilization of the drawer due to the weight and loading of the drawer, whereby the first point is within the pull out channels inner surfaces, and the second point is on the outer opposite sides of the pull out channels.

As shown in FIG. 3, when the drawer is pulled out, the first roller unit rolls along the drawer and the intermediate pull out channel up to a level when the intermediate pull out channel is partially under the drawer, while the outer pull out channel along with the second roller unit extends beyond the intermediate pull out channel, reaches around the front edge of the drawer. In this event, the back stopper 35 will hold the drawer in the stabilized position.

When a load is applied to the outer pull out channel, the vertical forces are mainly absorbed by the second roller unit, while the force produced from the outer pull out channel is thereby supported by the stabilizer and absorbed by the first roller unit. With the stabilizer, the load bearing capability of the guide rail during the lateral movement is significantly increased.

Proceeding from the above, because of the two differently rolling contacts, one within the pull channels and another at each side of a channel, a high static rigidity in operation can be achieved and since an additional stabilizer is provided within the guide rail, the dynamic stability can be obtained. The roller bearing may also prevent distorted movement within the guide rail of the present invention.

While the above provides a complete disclosure of the preferred embodiments of the present invention, various modifications, alternate constructions and equivalents may be employed without departing from the objective and scope of invention.

The invention claimed is:

1. A drawer guide rail assembly mounted for a guided and stabilized in and out movement with respect to a furniture member comprising:

a fixed guide for attachment to an inner sidewall of said furniture member and having at least one running surface;

an intermediate pull out channel capable of sliding back and forth relative to said fixed guide on said running surface of said fixed guide, an upper surface of said intermediate pull out channel section providing a second running surface;

a first roller bearing positioned within said intermediate pull out channel for enabling sliding movement of said intermediate pull out channel on said fixed guide;

an outer pull out channel for attachment to an undersurface of a drawer capable of sliding back and forth on said intermediate pull out channel relative to said intermediate pull out channel; and a second roller bearing positioned within said outer pull out channel for enabling sliding movement of said outer pull out channel on said intermediate pull out channel, said second roller bearing including roller bodies within a receptacle; wherein said fixed guide running surface is a T-shaped flange extending upwards; said drawer guide rail assembly further comprises a stabilizer positioned between said intermediate pull out channel and said outer pull out channel; said stabilizer is mounted on top of the intermediate pull out channel, and includes a shoulder which is horizontally extended from each side of said stabilizer to be fitted with said second roller bearing for guiding and stabilizing the movements of said outer pull out channel relative to said intermediate pull out channel; and the second roller bearing is disposed over the stabilizer.

2. The drawer guide rail assembly as claimed in claim 1, wherein said stabilizer is in the form of a metal sheet having inclined sides.

3. The drawer guide rail assembly as claimed in claim 2, wherein said stabilizer has its width wider than the width of said intermediate pull out channel.

4. The drawer guide rail assembly as claimed in claim 3, wherein said stabilizer includes a protrusion formed at the upper end of said stabilizer for retaining said second roller bearing in position during movement.

5. The drawer guide rail assembly as claimed in claim 1, wherein said stabilizer is detachably positioned between said intermediate pull out channel and said outer pull out channel.

* * * * *